United States Patent [19]

Cantrell

[11] 4,168,548

[45] Sep. 25, 1979

[54] VACUUM COMMODE

[76] Inventor: James W. Cantrell, P. O. Box 254, Young Harris, Ga. 30582

[21] Appl. No.: 730,067

[22] Filed: Oct. 6, 1976

Related U.S. Application Data

[63] Continuation of Ser. No. 444,965, Feb. 22, 1974, abandoned.

[51] Int. Cl.[2] ..... E03D 11/00; E03D 11/10; A61M 1/00

[52] U.S. Cl. ..... 4/1; 4/113; 4/431; 128/276; 128/283

[58] Field of Search ..... 4/1, 10, 72, 111–113, 4/138, 223, 253, DIG. 8, 300, 348, 420, 213, 431, 217, 434; 128/33, 276–278, 283, 2 F, 361

[56] References Cited

U.S. PATENT DOCUMENTS

| | | | |
|---|---|---|---|
| 257,740 | 5/1882 | Morgan | 4/113 |
| 543,402 | 7/1895 | Poppens | 4/138 |
| 2,981,255 | 4/1961 | Heyns | 128/361 |
| 3,034,131 | 5/1962 | Lent | 4/10 |
| 3,062,215 | 11/1962 | Heyns | 128/361 |
| 3,244,168 | 4/1966 | Bayard | 128/33 |
| 3,340,543 | 9/1967 | Cella | 4/10 |
| 3,527,203 | 9/1970 | Gravlee | 128/2 F |
| 3,626,941 | 12/1971 | Webb | 128/283 |
| 3,663,970 | 5/1972 | Drouhard, Jr. | 4/111 |
| 3,733,619 | 5/1973 | Smith | 4/348 |

FOREIGN PATENT DOCUMENTS

| | | | |
|---|---|---|---|
| 452920 | 11/1948 | Canada | 128/276 |

OTHER PUBLICATIONS

Birth Control Handbook, Journal Offset Inc., Copyright 1871, Montreal, Canada, Pertinent pp. 2 and 40–44.

*Primary Examiner*—Stuart S. Levy
*Attorney, Agent, or Firm*—Cushman, Darby & Cushman

[57] ABSTRACT

A vacuum commode is provided in which a bed pan has a sponge rubber seat cushion arranged between the bed pan and the user of the assembly. Inserted between the user and the seat cushion is a hand bulb air pump which is used to create a partial vacuum within the interior of the bed pan. The partial vacuum may be created because the rubber seat and a flexible plastic sheet spread over the patient's lap area provide an air-tight seal between the user and the interior air space of the bed pan. The air pump is used to create a partial vacuum within the interior of the bed pan which causes a suction-like effect therein, thus aiding in the excretion of waste matter from the bowels of the user.

8 Claims, 7 Drawing Figures

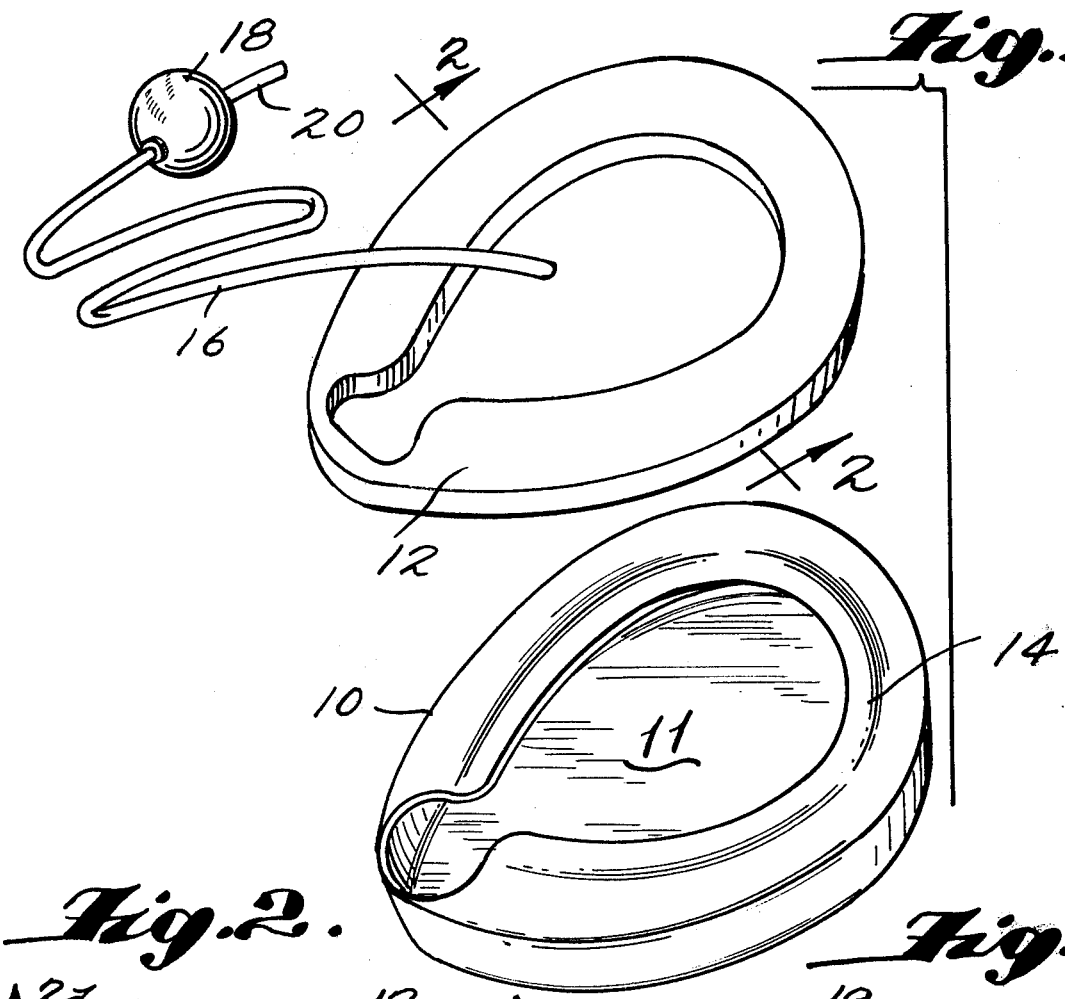
Fig. 1.
Fig. 2.
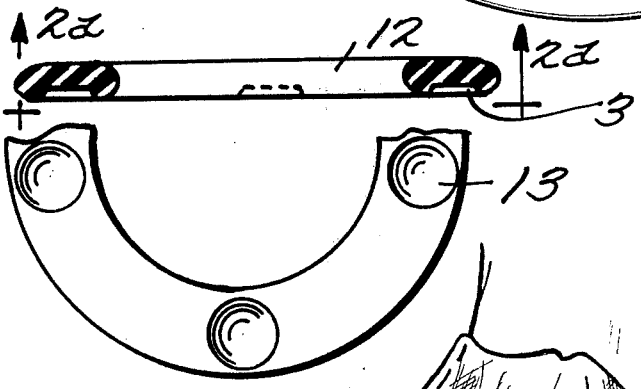
Fig. 2A.
Fig. 4.
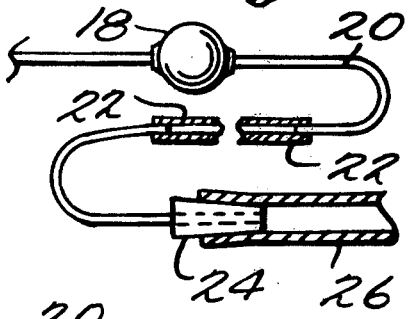
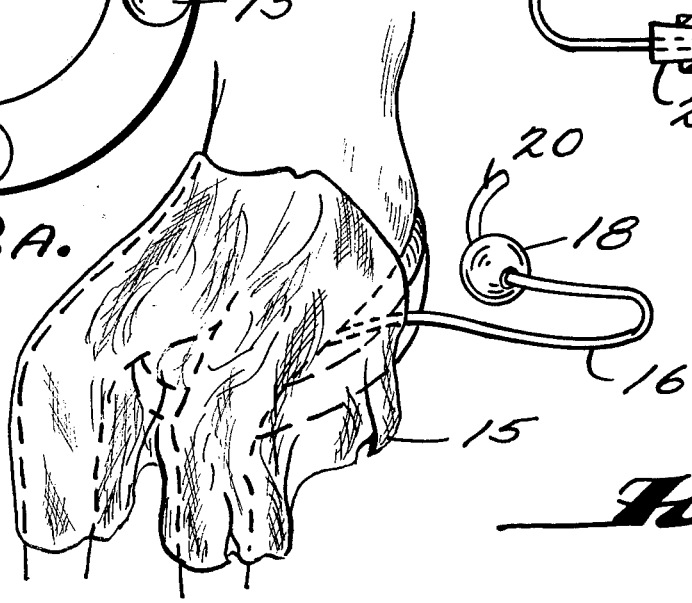
Fig. 3.

VACUUM COMMODE

This is a continuation, of application Ser. No. 444,965 filed Feb. 22, 1974 now abandoned.

BACKGROUND OF THE INVENTION

This invention relates to commodes, and more particularly to a vacuum commode in which a partial vacuum is created to aid in a commode user having a bowel movement.

Commodes as such are old in the art, but have not been addressed to the problem of aiding those of all ages and conditions whenever they are tardy, slow or painful on the commode. The employment of a partial vacuum used in conjunction with a slop jar or bed pan will greatly aid those partly immobilized in bed or senile or older patients suffering from lower intestinal problems which may render a bowel movement almost impossible or extremely painful. The use of enemas and suppositories will be all but eliminated. It is well known in medicine and physiology that as human beings become older internal organs such as the intestine and rectum tend to shrink or contract thus decreasing the orifice diameter which can often render defecation unpleasant and painful.

In the U.S. Pat. No. 257,740 there is disclosed a bed pan with a cushion which has an evacuating tube connected to the pan. The evacuating tube, however, is used only to provide for a discharge of overflow waste effluent from the bed pan. As such the device is not addressed to the problem of providing a vacuum-like effect for aiding an irrigation of the bowels.

In U.S. Pat. No. 543,402 there is set forth a commode or sanitary pail which has its upper aperture surrounded by a hollow ring which serves as a seat and a receptacle to contain a disinfectant which may be readily discharged into the pail when desired. As such, this patent also is not directed to aiding in a user's defecation.

Another U.S. Pat. No. 3,663,970 discloses an apparatus for pneumatic transportation of sanitary waste from a toilet to a holding tank. As such, this device while utilizing a vacuum pump to release pressure within a holding tank such reduction in pressure only promotes the sweeping of effluent through a transfer conduit to a holding tank. There is no suggestion or hint of creating a partial vacuum within the air space of the toilet bowl to cause an outflow of excretory matter from the toilet user's bowels.

A further patent to be set forth as prior art is U.S. Pat. No. 3,733,619 which describes and sets forth a method for ventilating a toilet. The ventilation system has as its primary purpose to remove offensive odors within a toilet bowl air space. An exhaust vent extends through the toilet seat from the inner lower edge to the outer lower edge and is connected to the discharge side of a vent fan. With the vent fan in operation air is swept through the inner space of the toilet bowl area and is removed by a discharge conduit.

SUMMARY OF THE INVENTION

It is therefore an object of the present invention to provide a vacuum commode in which a vacuum pump is used to evacuate an amount of air from the internal space of the bed pan so as to cause a partial vacuum therein and thereby aid in the emptying of a user's bowels. It is another object of the present invention to provide for a vacuum commode in which a sealing means is employed between a commode user and a bed pan made of soft sponge rubber-like material, thus providing a comfortable seat.

It is another object of the present invention to provide for a vacuum commode which may be readily used for bed-ridden patients. The commode may be operated by means of a simple hand bulb air pump to create a partial vacuum within the bed pan thereby resulting in a pleasing and comforting relief of the user's bowels by use of the suction-like force with the possible aid of a suppository instead of an enema.

It is a further object of the present invention to provide for a vacuum pump means which may be operatively connected to a vacuum cleaner or other vacuum producing means so that a more rapid partial vacuum may be effectuated within the interior of the bed pan.

It is still another object of the present invention to provide for a pleasing effect on the bowels during defecation the natural function of a bowel movement.

Additional objects of the present invention reside in the specific construction of the exemplary apparatus hereinafter particularly described in the specification and shown in the several drawings.

BRIEF DESCRIPTION OF THE DRAWINGS

FIG. 1 is an exploded view of the bed pan and rubber seat showing the placement of the air pump.

FIG. 2 is a cross-sectional view taken along lines 2—2 of the rubber seat of FIG. 1.

FIG. 2*a* is a view taken along lines 2*a*—2*a* of FIG. 2.

FIG. 3 is a schematic view of a patient or user sitting on the commode device wherein plastic sheet material is used as a final sealing means over his lap area.

FIG. 4 is a diagramatic view of the exhaust valve of the evacuating hose connected by means of a coupling to a stopper which is inserted in a vacuum cleaner intake hose.

DETAILED DESCRIPTION OF THE INVENTION

Figure 5:
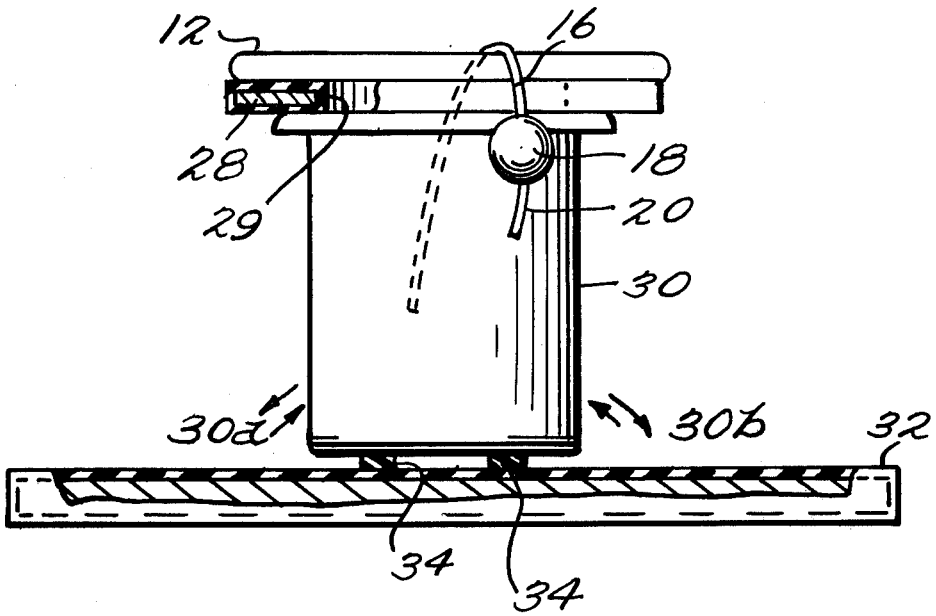
FIG. 5 is a side elevational view of a second embodiment of the present invention.

Referring now to FIG. 1 of the drawings, there is shown a typical bed pan represented by reference numeral 10. A cushion of soft sponge rubber or like substance is formed as a cushion or seat 12 which fits onto upper surface 14 of the bed pan 10. The cushion 12, as can be seen from a viewing of FIG. 2, is provided with suction cups on its bottom surface which rigidly secure and seal the seat 12 in air-tight relationship to the bed pan 10.

In the exemplary embodiment of the present invention, it is contemplated that a user of the vacuum commode bed pan device will seat himself upon the bed pan 10 with sponge rubber seat 12 placed between the commode user's underside and the bed pan 10. The weight of the user will bear down on rubber seat 12 and result in an air-tight seal between the user and the receptacle or bed pan 10. An efficient air-tight seal would be effectuated if the commode user kept the inside of his thighs tightly pressed together. However, as such usually is not the case, a sheet of flexible plastic bag material such as is used in dry cleaning bags must be spread over the upper portion of the user's thighs and down around his pelvic area. Such a use of a flexible sheet can be seen from an understanding of FIG. 3. With the flexible sheet of plastic material 15 firmly in place, air from the atmosphere may not get into the interior space 11 of the bed pan 10 to reduce the suction-like force to be subsequently described.

Inserted underneath the patient's leg, and depending downwardly over the rubber seat 12 is a hose 16 which is operatively connected to a hand bulb air pump 18. The hose 16 is constructed of hard rubber sufficiently rigid so that the commode user's weight will not cause the passage-way through hose 16 to become obstructed. Extending from another direction of the pump 18 is an exhaust valve 20.

As the user is seated upon the rubber seat 12 and bed pan 10 with plastic sheet 15 firmly in place he may compress and then release bulb 18 thereby drawing air outwardly from the interior 11 of the bed pan through hose 16, thus causing a partial vacuum to exist therein. This partial vacuum will result in a pulling or suction-like force upon the user's anus which in turn transmits the suction-like force through the rectum toward the colon, and causes evacuation. For a more rapid defecation to take place, the user may depress and release the pump 18 in a more vigorous manner.

For anyone chronically or occasionally having a problem which causes a bowel movement to be extremely painful or nearly impossible, a greater suction force may have to be applied through hose 16. This greater suction force may be effectuated through the use of a vacuum cleaner or other vacuum-producing device. To use such a device, exhaust valve 20 is connected by means of a coupling 22 to a suitable stopper 24 which may be inserted into the intake hose 26 of a vacuum cleaner. It may be readily understood that when such a vacuum cleaner is operatively connected to exhaust valve 20 a partial vacuum may be created quickly within inner space 11 of bed pan 10.

Another embodiment of the instant invention is shown in FIG. 5 wherein to aid in user comfort and relaxation of the intestinal area, a substantially longitudinal upper board 28 being encased in soft sheet rubber with an aperture 29 suitable to be encircled by rubber seat 12 may be inserted between rubber seat 12 and a slop jar 30. The patient, by grasping the ends of upper board 28 may rock himself back and forth in the direction of arrows **30*a* and 30*b*. This rocking causes a jolting or joggling effect and a kneading of the soft area between the anus and the bottom of the spine so that any too hard contents of the anus are squeezed in passage into a comfortable diameter. To effectuate the jolting effect, the slop jar 30 is placed on a lower rubber encased board 32 provided with hard rubber cross ribs 34. When the user rocks the board 28 and jar 30 back and forth across the ribs 34** there is a jolting effect.

Figure 6:
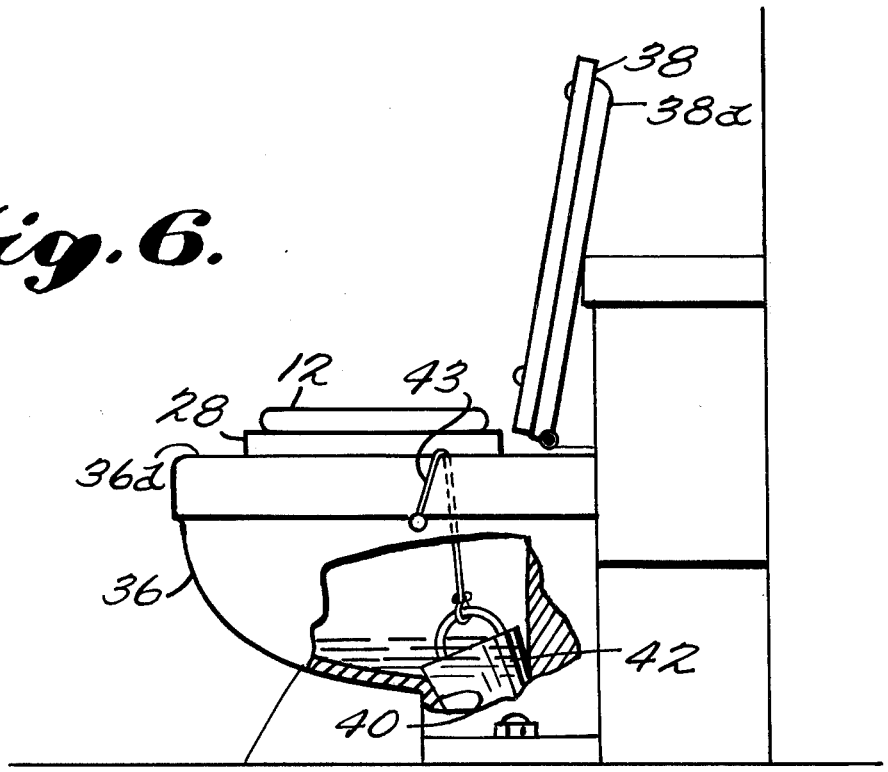
FIG. 6 is a side elevational view of a toilet bowel utilizing the principles of the present invention.

The principles of the present invention may also be employed in the alternative assembly illustrated in FIG. 6. Here, an ordinary bathroom commode or ceramic toilet bowl 36 has hinged lids 38 and **38*a* turned up so that the apertured board 28 with rubber seat cushion 12 may be placed on rim surface 36*a*. The water trap 40 of bowl 36 is blocked up with a rubber plug 42** designed to float automatically if not removed before the toilet is flushed.

To aid the removal of plug 42, a tug line or cord 43, preferably of nylon, is attached to plug 42 and hangs over rim **36*a*. Cord 43 is small enough so that the seal between the bottom side of rubber encased board 28 and rim 36*a* will not be affected. Hand pump 18 is used in conjunction with the toilet bowl configuration in the same manner as hereinbefore described. A vacuum cleaner may also be employed to more quickly create a partial vacuum within the interior of the bowl. Rubber-encased boards 28 extends past the rim 36*a*** so that the user may grip the ends of it.

It should also be pointed out that many of the reflexive and volitional motions of the user such as seating himself, settling and adjusting himself will tend to pump more air from the pan, while motions of the opposite tendency cannot admit more air because the exhaust valve 20 will exclude it. Various motions have been found experimentally to stimulate directly the act of the bowels. Because the hand bulb air pump 18 is a typical squeeze bulb pump which will allow air to pass only in one direction, that is through hose 16 outwardly through exhaust valve 20, no air will be admitted to the interior of the slop jar while the user settles and adjusts himself upon the rubber seat cushion.

While the invention has been particularly shown and described with reference to the foregoing preferred embodiment thereof, it will be understood by those skilled in the art that other changes in form and detail may be made therein without departing from the spirit and scope of the invention as defined in the appended claims.

What is claimed is:

1. A commode comprising:

(a) a waste receptacle having an upper aperture to serve as a seat for a user, and an interior portion;

(b) means for providing an air-tight seal between a commode user seated on the aperture and said receptacle; and (c) means for creating a partial vacuum by reducing the air pressure within the receptacle as closed off by the user and said sealing means relative to the air pressure acting upon the body of the user for the purpose of aiding in defecation by the user into the receptacle, wherein said sealing means comprises a cushion formed of soft sponge rubber adapted to encircle said aperture of said receptacle, said cushion having an underside portion thereof provided with suction cups to secure and seal said seat to said receptacle, wherein said sealing means further comprises a sheet of flexible plastic material which is spread over a commode user's lap and inner leg area, said seat providing an air-tight seal between said commode user and said receptacle and said sheet means further preventing air leakage from the atmosphere to the receptacle inwardly through a space existing between said user's legs; and wherein said commode user by seating and adjusting himself upon said cushion causes a partial expelling of air from within the interior of the receptacle through the partial vacuum creating means.

2. The commode of claim 1 wherein said partial vacuum creating means comprises a hand bulb air pump with an exhaust valve, said pump being operatively connected to a hose which is placed between the commode user and said cushion and is disposed within the interior of said receptacle so that when said bulb is compressed and released a predetermined number of times by said commode user, a partial vacuum results in said receptacle which thereby aids said commode user in defecation.

3. The commode of claim 2 wherein said hose is adapted to be operatively connected with a stopper to a vacuum cleaner intake hose so that a larger partial vacuum may be created within said receptacle.

4. The commode of claim 3 wherein said receptacle is a bed pan.

5. The commode of claim 2 wherein said receptacle is a slop jar and a substantially longitudinal upper board having an aperture is disposed between said slop jar and said cushion seat, and a lower board provided with cross ribs is disposed beneath said slop jar so that a commode user may rock himself back and forth by grasping the outer ends of said upper board, whereby a jolting and joggling effect is imparted to the lower back area of said commode user.

6. The commode of claim 5 wherein said hose is adapted to be operatively connected with a stopper to a vacuum cleaner intake hose so that a larger partial vacuum may be created within said slop jar.

7. The commode of claim 2 wherein said receptacle is a ceramic toilet bowl having a water trap and a removable plug, wherein a substantially longitudinal board having an aperture is disposed between said cushion and said toilet bowl, said plug having a tug line secured thereto and extending underneath said board and depending outside of said bowl.

8. The commode of claim 7 wherein said hose is adapted to be operatively connected with a stopper to a vacuum cleaner intake hose so that a larger partial vacuum may be created within said bowl.

* * * * *